United States Patent [19]

Aoi et al.

[11] Patent Number: 4,617,881

[45] Date of Patent: Oct. 21, 1986

[54] ACTUATING MECHANISM FOR MULTIPLE VALVE INTERNAL COMBUSTION ENGINE

[75] Inventors: Kazuo Aoi, Hamamatsu; Naoki Tsuchida, Iwata, both of Japan

[73] Assignee: Yamaha Hatsudoki Kabushiki Kaisha, Iwata, Japan

[21] Appl. No.: 717,832

[22] Filed: Mar. 29, 1985

[51] Int. Cl.[4] ..... F01L 1/26

[52] U.S. Cl. ..... 123/90.27; 123/90.22; 123/90.4; 123/90.44

[58] Field of Search ..... 123/90.27, 90.39, 90.40, 123/90.41, 90.22, 90.23, 90.6, 90.44

[56] References Cited

U.S. PATENT DOCUMENTS

| | | | |
|---|---|---|---|
| 1,271,764 | 7/1918 | Pullinger | 123/90.22 |
| 1,609,149 | 11/1926 | Wilkinson | 123/90.27 |
| 2,103,024 | 12/1937 | Smith | 123/90.27 |
| 3,219,019 | 11/1965 | Palmer | 123/90.27 |
| 3,299,871 | 1/1967 | Apfelbeck | 123/90.27 |

FOREIGN PATENT DOCUMENTS

| | | | |
|---|---|---|---|
| 1751401 | 2/1971 | Fed. Rep. of Germany | 123/90.27 |
| 2056150 | 5/1971 | Fed. Rep. of Germany | 123/90.27 |
| 2063362 | 6/1981 | United Kingdom | 123/90.27 |

*Primary Examiner*—Ira S. Lazarus

*Attorney, Agent, or Firm*—Ernest A. Beutler

[57] ABSTRACT

Two embodiments of valve arrangements for internal combustion engines that permits the use of a plurality of valves for a given combustion chamber while operating all of the valves through a simplified camshaft arrangement. Some of the valves are operated directly by the cam lobes and others are operated by rocker arms. In addition, an embodiment is disclosed wherein a two rocker arm arrangement is employed for operating certain valves.

15 Claims, 7 Drawing Figures

Fig-2
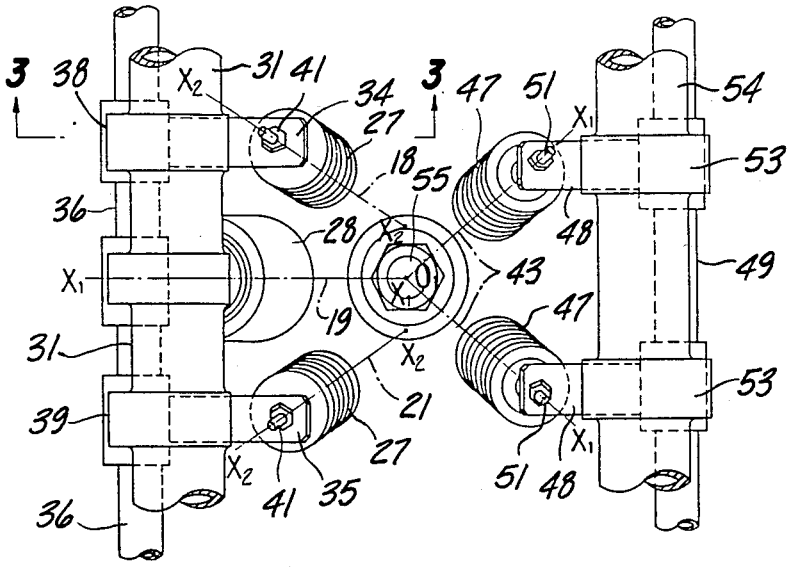
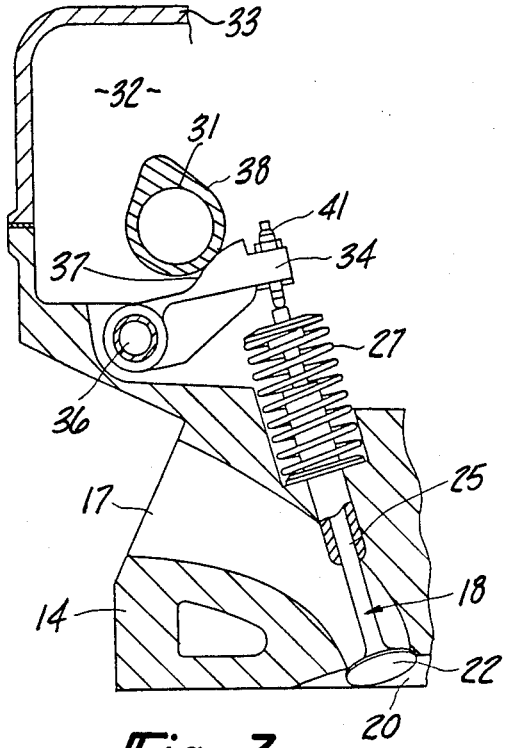
Fig-3
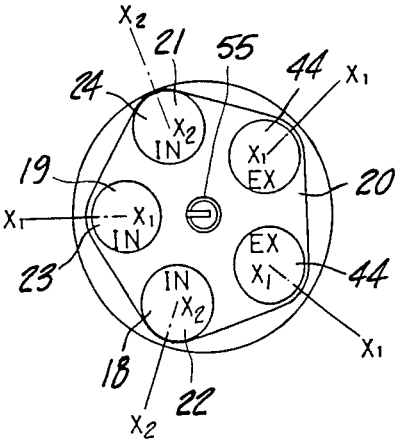
Fig-4

Fig-6
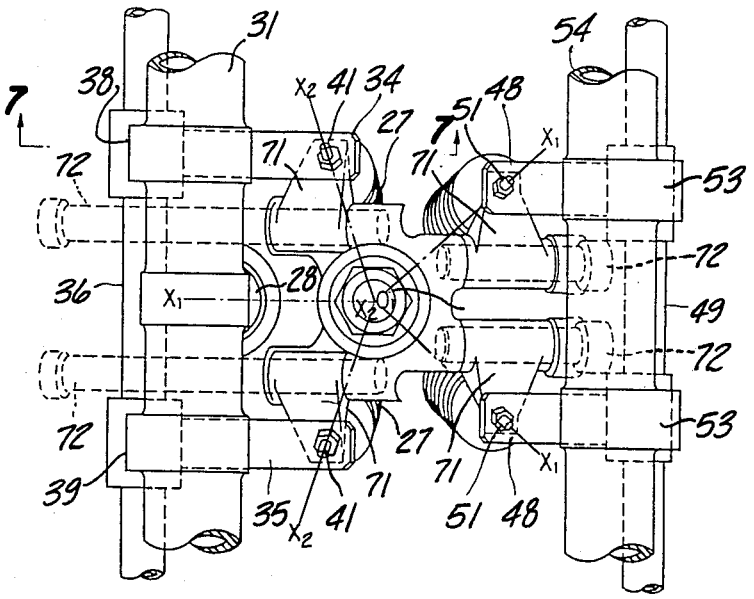
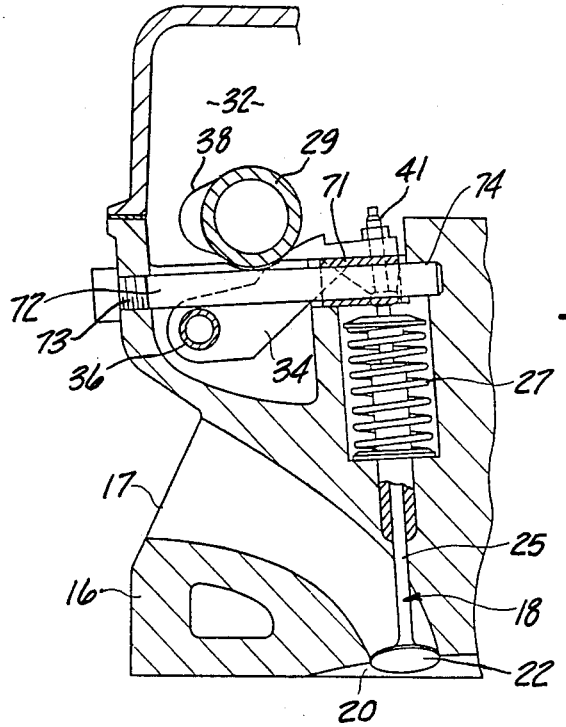
Fig-7

ACTUATING MECHANISM FOR MULTIPLE VALVE INTERNAL COMBUSTION ENGINE

BACKGROUND OF THE INVENTION

This invention relates to an actuating mechanism for a multiple valve internal combustion engine and more particularly to an improved and compact valve arrangement for operating multiple valves in a single chamber of an internal combustion engine.

The advantages of the use of multiple valves for a single chamber of an internal combustion engine are well known. Among these advantages is the provision of a greater flow area within a given surface area with reduced operating component inertias. Because of this and other advantages, it has been proposed to employ engines having at least three valves per cylinder. In fact, engines having a greater number of valves per cylinder have been proposed and have a number of advantages. However, there is a practical limit, with engines of the type previously proposed, as to the number of valves that may be employed in a given cylinder. Although it may be physically possible to provide multiple valves, there are other factors governed by the valve placement. For example, it is possible to use a large number of valves if the supporting area for the valves, be it the cylinder head or cylinder block, has a large surface area. However, the use of such large surface areas significantly increases the clearance volume of the engine and reduces the compression ratio. A reduction in the compression ratio, obviously, reduces the output efficiency of the engine and thus the advantages of the use of multiple valves is offset by this disadvantage. Furthermore, there is a practical limit to the types of actuating elements that may be used for the valves and this further determines the valve placement. With prior art types of devices, it has been relatively impractical to provide more than three or four valves in a given cylinder, particularly where it is desired to provide more than two valves that provide the same function.

It is, therefore, a principal object of this invention to provide an improved arrangement for placing and actuating the valves of an internal combustion engine.

It is another object of this invention to provide a valve arrangement for an internal combustion engine that permits an increase in the number of valves that are employed without complicating the engine construction.

It is yet a further object of this invention to provide an improved and simplified arrangement for actuating plural valves of a given combustion chamber of an internal combustion engine.

SUMMARY OF THE INVENTION

This invention is adapted to be embodied in a valve train for an internal combustion engine having a first poppet valve that is supported for recriprocation along an axis that is defined by its stem and a second poppet valve that is also supported for reciprocation about an axis that is defined by its stem. A camshaft is supported for rotation about a rotational axis that is intersected by the first poppet valve stem axis. Cam means on the camshaft are provided for directly operating the first valve. A rocker arm is supported for pivotal movement and cam means on the camshaft are provided for pivoting the rocker arm upon rotation of the camshaft.

Means on the rocker arm are operative to actuate the second valve upon pivotal movement of the rocker arm.

A yet further feature of the invention is adapted to be embodied in an arrangement for actuating a poppet valve of an internal combustion engine that is supported for reciprocation along its stem axis. A camshaft is provided for rotation about a rotational axis and has a cam lobe. A first rocker arm is supported for pivotal movement about a first rocker arm pivot axis and is engaged with the cam lobe for pivoting the first rocker arm upon rotation of the camshaft. A second rocker arm is supported for pivotal movement about a second rocker arm pivot axis and has a portion that is engaged with the first rocker arm for pivoting the second rocker arm about its pivot axis upon pivotal movement of the first rocker arm. The second rocker arm has a portion that is engaged with the poppet valve for operating the poppet valve upon pivotal movement of the second rocker arm.

BRIEF DESCRIPTION OF THE DRAWINGS

FIG. 2 is a top plan view showing the valve placement and actuation of the engine in the embodiment of FIG. 1.

FIG. 3 is a cross-sectional view taken generally along the line 3—3 of FIG. 2 and shows the arrangement for operating one of the valves.

FIG. 4 is a view looking generally in the direction of the line 4—4 in FIG. 1 and shows the valve placement within the cylinder head.

FIG. 6 is a view, in part similar to FIG. 2, and shows the corresponding view for the embodiment of FIG. 5.

FIG. 7 is a cross-sectional view taken along the line 7—7 of FIG. 6.

DETAILED DESCRIPTION OF THE PREFERRED EMBODIMENTS

Embodiment Of FIGS. 1 Through 4

Figure 1:
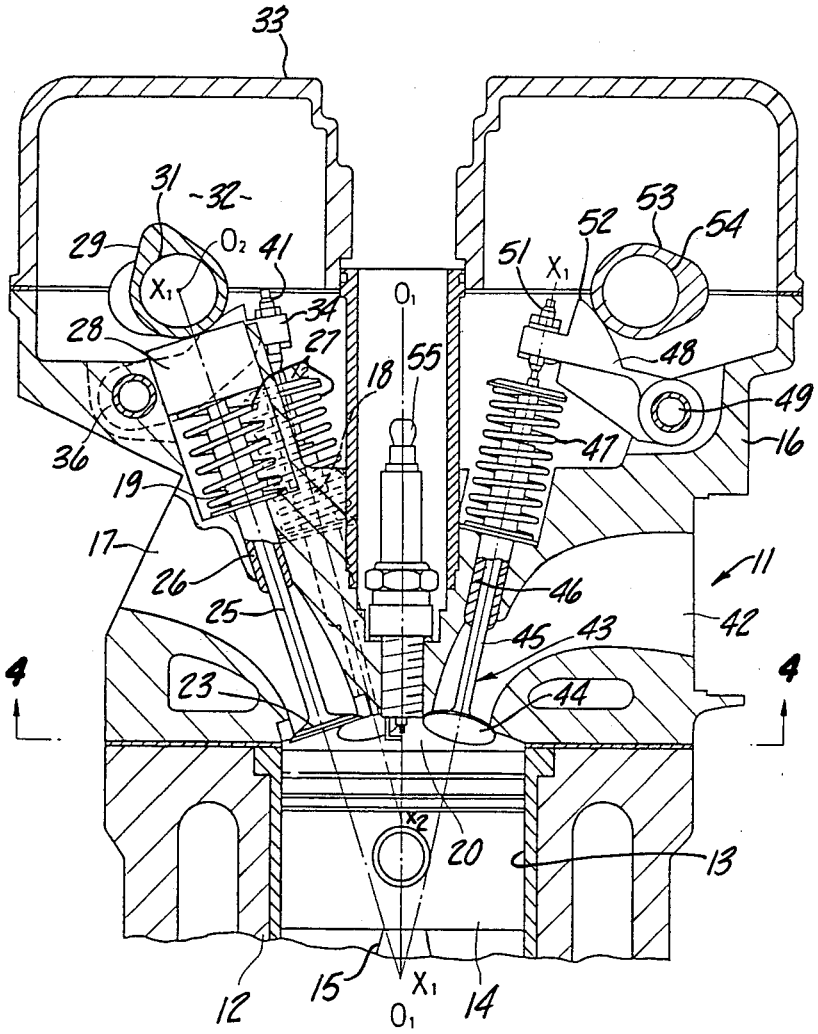
FIG. 1 is a partial cross-sectional view taken through the axis of a cylinder of an internal combustion engine constructed in accordance with a first embodiment of the invention.

An internal combustion engine constructed in accordance with a first embodiment of the invention is identified generally by the reference numeral 11. Since the invention is concerned primarily with the valve gear for the engine, only this portion of the engine has been illustrated in detail. Also, for this reason, only a single cylinder of the engine has been illustrated and will be described. It is to be understood, however, that the invention is susceptible of use with multiple cylinder engines having any of the known type of configurations such as inline, V type, etc.

The engine 11 includes a cylinder block 12 having a cylinder bore 13 in which a piston 14 is supported for reciprocation. The piston 14 is connected by means of a connecting rod 15 to a crankshaft in a known manner.

A cylinder head, indicated generally by the reference numeral 16 is affixed to the cylinder block 12 and has a cavity 20 that is configured above the cylinder bore 13 and with the cylinder bore 13 and head of the piston 14 forms a volume that varies during the operation of the engine and which may be referred to hereafter as the combustion chamber.

An induction system is provided for the combustion chamber 20 that is comprised of a plurality of intake passages 17 that extend through the cylinder head 16 from the cavity 20 to one of its outer faces. If desired, the passages 17 may be connected with each other or, in fact, may form a single passage that terminates in three respective valve seats. The flow through these three intake valve seats is controlled by a respective poppet valve 18, 19 and 21, each of which has a respective valve head 22, 23 and 24 and a supporting stem portion, each indicated by the reference numeral 25. The respective stem portions are slidably supported within valve guides 26 pressed into the cylinder head 16 in a known manner.

Coil compression springs 27 encircle each of the respective valve stems 25 and are engaged with suitable keeper arrangements so as to urge the intake valves 18, 19 and 21 all toward their closed position wherein their respective heads 22, 23 and 24 engage the cooperating valve seats of the cylinder head 16.

A thimble tappet 28 is associated with the stem 25 of the center intake valve 19 and is engaged with a lobe 29 of a camshaft 31 for direct actuation by the cam lobe 29. The camshaft 31 is suitably journaled within an intake cam chamber 32 formed by the cylinder head 16 and a cam cover 33 that is affixed to the cylinder head 16.

Rocker arms 34 and 35 are provided for each cylinder bore 13 and are suitably journaled on a rocker arm support shaft 36 that is carried in the cylinder head 16 toward its outer periphery. Each rocker arm has a follower portion 37 that is engaged by a respective cam lobe 38 or 39 of the camshaft 31 for pivoting the rocker arms 34 and 35 about the rocker arm shaft 36 upon rotation of the camshaft 31. Adjusting screws 41 are carried by the ends of the rocker arms 34 and 35 and engage the stems 25 of the valves 18 and 21 for effecting their actuation.

A pair of exhaust passages or a single siamese exhaust passage 42 extends from the cylinder head cavity 20 through the side of the cylinder head opposite to the intake passages 17. A pair of exhaust valves 43 of the poppet type have heads 44 for controlling the flow through individual valve seats formed at the ends of the exhaust ports 42. The exhaust valves 43 have stem portions 45 that are slidably supported in guides 46 carried by the cylinder head 16. The axis of reciprocation of the exhaust valves 43 $X_1$-$X_1$ is disposed so that they intersect each other and also intersect the axis of reciprocation of the center intake valve 19 $X_1$-$X_1$ at a point that is located on the axis of the cylinder bore 13 $0_1$-$0_1$. In the plane of FIG. 1, the axes of the exhaust valves 43 extend at the same angle to the cylinder bore axis $0_1$-$0_1$, however, as seen in FIG. 2, these valves are disposed at an angle to each other, as aforenoted. The axis of reciprocation of the intake valve 19 $X_1$-$X_1$ intersects the axis of rotation of the camshaft 31, which axis is identified by the point $0_2$.

Valve springs 47 encircle the upper portion of the valve stems 45 and are retained by suitable keepers for urging the valves 43 toward their closed positions.

A pair of exhaust valve rocker arms 48 are journaled at the respective side of the cylinder head 16 by means of a exhaust rocker arm shaft 49. Adjusting screws 51 are carried at the ends of the rocker arms 48 and engage the respective tips of the valve stems 45 for actuating the valves 43 upon pivotal movement of the rocker arms 48.

The exhaust valve rocker arms 48 have follower portions 52 that are engaged by respective cam lobes 53 of an exhaust camshaft 54 that is journaled within the cylinder head 16 in a suitable manner. The axis of rotation of the exhaust camshaft 54 is disposed radially outwardly from the cylinder bore axis $0_1$-$0_1$ from the line of reciprocation $X_1$-$X_1$ of the exhaust valves 43.

As may be readily seen from FIG. 1, the intake valves 21 and 18 are disposed at the same angle to a perpendicular plane passing through the cylinder bore axis $0_1$-$0_1$. However, as is readily apparent from FIG. 2, the axes of reciprocation of these valves $X_2$-$X_2$ intersect this plane at a point vertically above the point of intersection of the remaining three valves. That is, the intake valves 18 and 21 are at a shallower angle to this plane than is the intake valve 19.

The configuration of the combustion chamber 20 and specifically the portion of it formed by the cylinder head recess may be best seen in FIG. 4 which is a bottom plan view looking at the chamber. It will be seen that the intake valves 18 and 21 are at the periphery of the chamber while the remaining intake valves are positioned slightly inwardly of the chamber. A spark plug 55 is provided with its gap located at the center of the chamber on the cylinder bore axis $0_1$-$0_1$.

The described valve positioning and spacing provides maximum flow area while at the same time minimizing the volume of the chamber 20 so as to permit high compression ratios. This is achieved in part due to the novel actuating mechanism employed for the valves.

Figure 5:
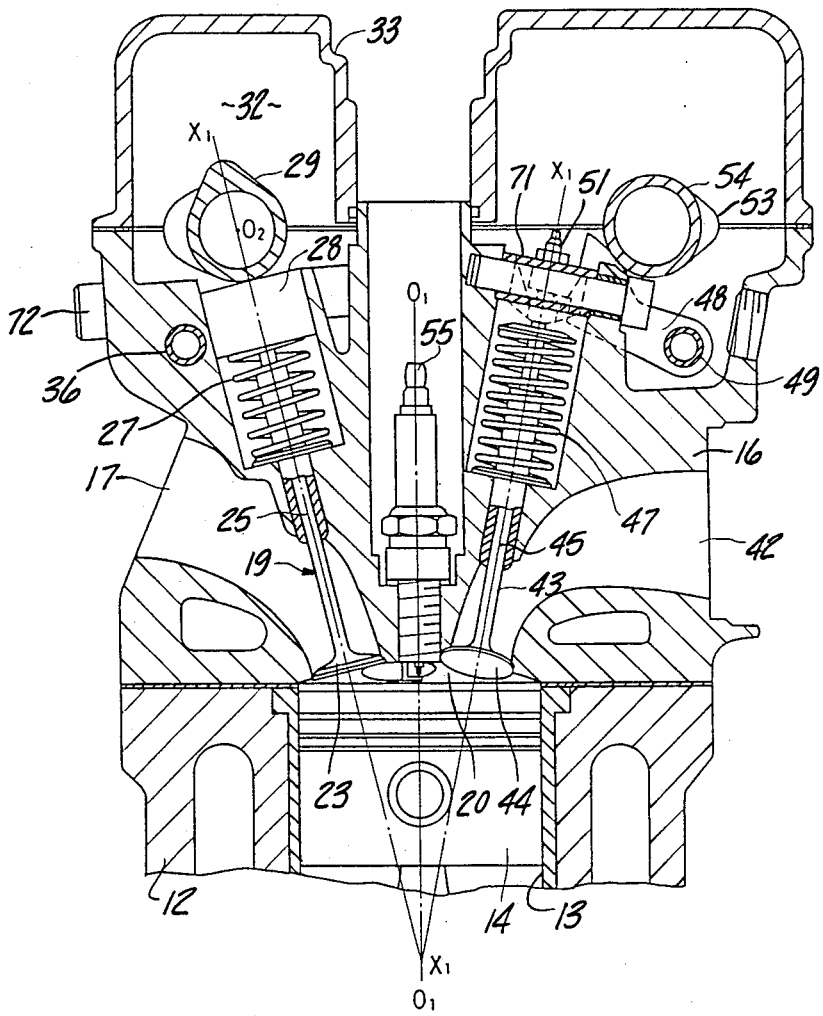
FIG. 5 is a cross-sectional view, in part similar to FIG. 1, and shows another embodiment of the invention.

Embodiment Of FIGS. 5 Through 7

In the embodiment of FIGS. 1 through 4, the valves which were operated through the rocker arms were skewed at an angle to the actuating rocker arm. As a result, there will be some sliding movement between the adjusting screws 41 and 51 and the valve stems during their operation. FIGS. 5 through 7 show another valve actuating mechanism that will avoid such movement. In other regards, this embodiment is the same as the embodiment of FIGS. 1 through 4 and, for that reason, the components which are the same have been identified by the same reference numerals and will not be described again in detail, except insofar as is necessary to understand the operation of this embodiment.

The adjusting screws 41 of the rocker arms 34 and 35 and the adjusting screws 51 of the rocker arms 48, rather than being engaged directly with the respective valves 18, 21 and 43 is engaged with a further rocker arm 71. Each rocker arm 71 is supported for reciprocation about an axis that extends generally perpendicularly to the rocker arm shaft axes 36 and 49 by means of a respective pivot shaft 72 that has a threaded portion 73 that is threaded into the outer periphery of the cylinder head and an end portion 74 that is journaled in an appropriate bore formed in a portion of the cylinder head. By using such a two rocker arm assembly, the end of the rocker arm 71 that engages the repective valve 18, 21 or 43 will follow the tip of this valve during its reciprocating movement and there will be substantially no sliding movement between these two components.

It should be readily apparent from the foregoing description that two embodiments of the invention have been illustrated and described that permits the use of multiple valves in an internal combustion engine for each chamber and which provides a compact arrangement. In addition, an arrangement is described in one embodiment wherein sliding movement between the valve actuating element and the valve stem is minimized. Although two embodiments of the invention have been illustrated and described, various changes and modifications may be made, without departing from the spirit and scope of the invention, as defined by the appended claims.

We claim:

1. A valve train for an internal combustion engine having a cylinder bore having a bore axis, a first poppet valve supported for reciprocation along a valve axis defined by its stem, a second poppet valve supported for reciprocation about a valve axis defined by its stem, a camshaft supported for rotation about a rotational axis intersected by said first poppet valve stem axis and extending parallel to a plane containing said bore axis, cam means on said camshaft for opening directly said first valve, a rocker arm supported for pivotal movement, cam means on said camshaft for pivoting said rocker arm, and means on said rocker arm operative to actuate said second valve upon pivotal movement of said rocker arm, said valve axes lying on the same side of said plane as said rotational axis.

2. A valve train as set forth in claim 1 wherein the first and second valves control the flow through ports that serve the same function for the engine.

3. A valve train as set forth in claim 1 further including a cylinder head supporting the first and second valves and the camshaft.

4. A valve train as set forth in claim 3 wherein the first and second valves control the flow through ports that serve the same function for the engine.

5. A valve train as set forth in claim 1 further including a third poppet valve reciprocating along an axis defined by its stem and a further cam means and rocker arm for actuating said third valve.

6. A valve train as set forth in claim 5 wherein the valves all serve the same function.

7. A valve train as set forth in claim 6 wherein the valves are all angularly disposed to each other.

8. A valve train as set forth in claim 7 wherein the valves are not parallel.

9. A valve train as set forth in claim 8 wherein the axis of the second and third valves are at the same angle to a plane containing the axis of an associated cylinder bore, which angle is less than the angle of the second valve axis to the same plane.

10. A valve train as set forth in claim 2 wherein the means on the rocker arm for actuating the second valve comprises means for engaging a second rocker arm pivotal about an axis angularly disposed to the axis of the first rocker arm and which second rocker arm directly engages the valve.

11. A valve train for an internal combustion engine having a first poppet valve supported for reciprocation along an axis defined by its stem, a seoond poppet valve supported for reciprocation about an axis defined by its stem, a third poppet valve supported for reciprocation about an axis defined by its stem, a camshaft supported for rotation about a rotational axis intersected by said first poppet valve stem axis, first cam means on said camshaft for opening directly said first valve, first and second rocker arms supported for pivotal movement about a common axis, cam means on said camshaft on opposite sides of said first cam means for pivoting said first and second rocker arms respectively, and means on said first and second rocker arms operative to actuate said second and third valves upon pivotal movement of said first and second rocker arms.

12. A valve train as set forth in claim 11 wherein the valves control the flow through ports that serve the same function for the engine.

13. A valve train as set forth in claim 12 wherein the valves are all angularly disposed to each other.

14. A valve train as set forth in claim 13 wherein the valves are not parallel.

15. A valve train as set forth in claim 14 wherein the axis of the first and third valves are at the same angle to a plane containing the axis of an associated cylinder bore, which angle is less than the angle of the second valve axis to the same plane.

* * * * *